US005084046A

United States Patent [19]

Isack

[11] Patent Number: 5,084,046

[45] Date of Patent: Jan. 28, 1992

[54] DEPILATOR

[75] Inventor: Agadi Isack, Oranit, Israel

[73] Assignee: Rony Mann, Holon, Israel

[21] Appl. No.: 344,385

[22] Filed: Apr. 28, 1989

[51] Int. Cl.[5] ..... A61B 17/00

[52] U.S. Cl. ..... 06/36; 606/43; 606/133

[58] Field of Search ..... 606/32, 36, 41, 43, 606/131, 133

[56] References Cited

U.S. PATENT DOCUMENTS

| | | | |
|---|---|---|---|
| 2,714,788 | 8/1955 | Gioyanna | 51/170 T |
| 4,079,741 | 3/1978 | Daar et al. | 606/133 |
| 4,459,987 | 7/1984 | Pangburn | 606/131 |
| 4,524,772 | 6/1985 | Daar et al. | 606/133 |

*Primary Examiner*—Robert A. Hafer
*Assistant Examiner*—Lynda M. Cofsky
*Attorney, Agent, or Firm*—Fleit, Jacobson, Cohn, Price, Holman & Stern

[57] ABSTRACT

There is provided a method and device for depilating hair from various members of the human body, especially arms and legs. The device is based on a rotating head driven by suitable means, which head is provided with an abrasive surface. The method of depilating hair comprises contacting the area of the skin from which hair is to be removed with such rotating surface.

The abrasive used is a fine grain one so as to minimize irritation of sensitive human skin.

10 Claims, 4 Drawing Sheets

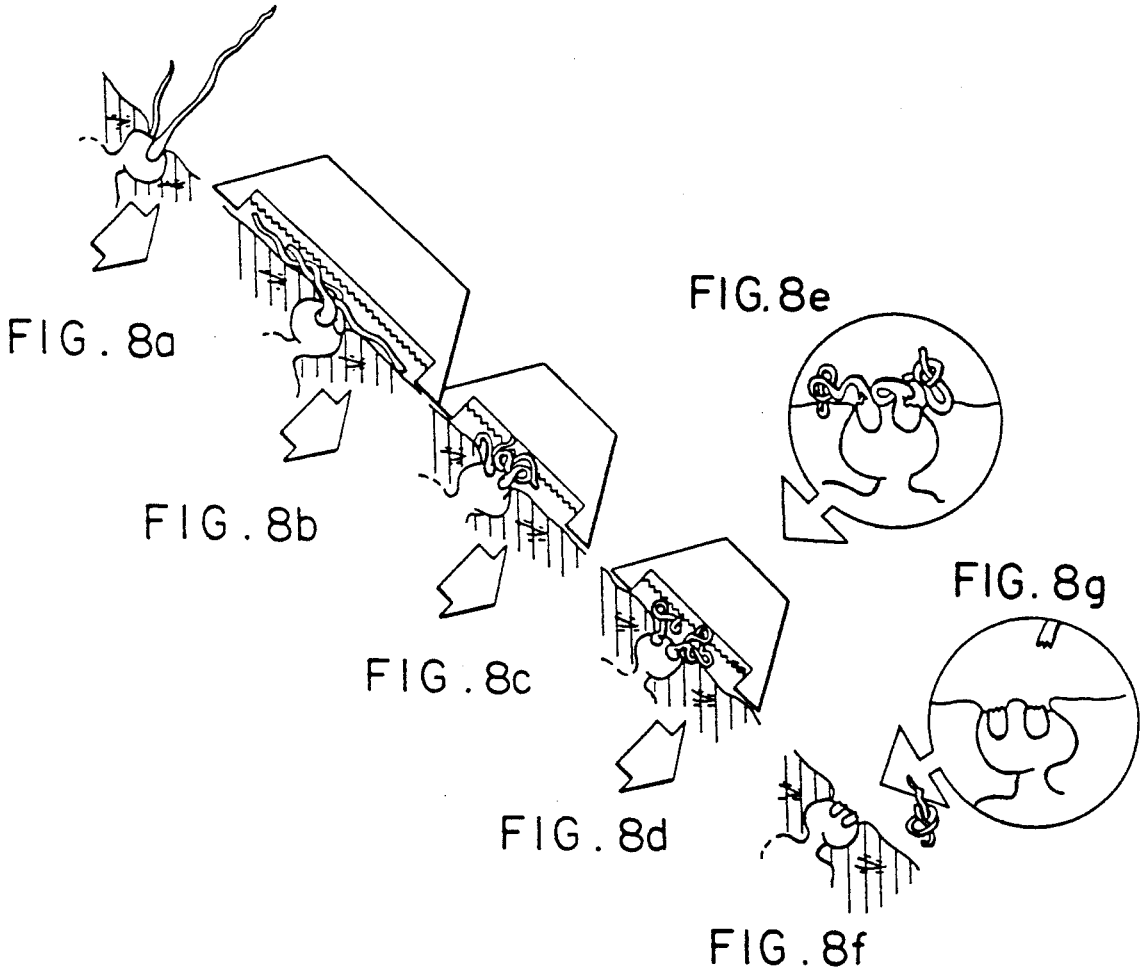
FIG. 8a
FIG. 8b
FIG. 8c
FIG. 8d
FIG. 8e
FIG. 8f
FIG. 8g
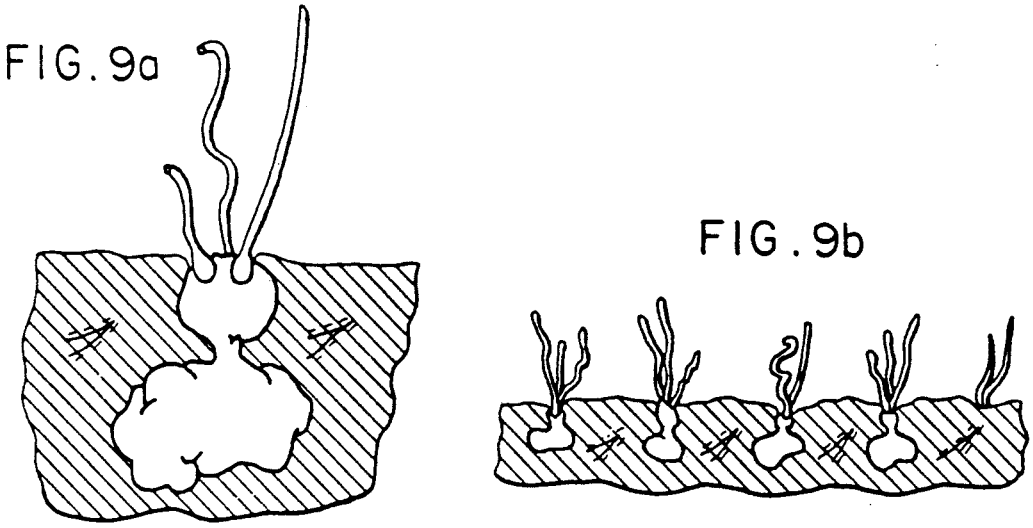
FIG. 9a
FIG. 9b

DEPILATOR

FIELD OF THE INVENTION

The invention relates to a depilatory device. The device is characterized by simplicity of construction, it is inexpensive and most important—its action is practically without pain or discomfort. The invention is based on means for contacting the hairy area with a rotating surface provided with an abrasive layer. The rotation is advantageously an excentric one. The distance of the abrasive layer from the skin during operation is adjustable.

BACKGROUND OF THE INVENTION

During recent years various depilatory devices have come on the market, and at least one of them has been a very substantial commercial success.

It is one of the drawbacks of the conventional devices, whether these are based on rotating helixes or on slotted rubber members or the like, that they engage the hair and ultimately pull it out causing discomfort and some pain. A variety of such devices has been proposed, but as most of them cause actual pain, people are reluctant to use them. Even so-called "improved models" suffer from the same drawback.

The present invention surprisingly overcomes this drawback and results in an effective depilation with substantially no discomfort or pain.

SUMMARY OF THE INVENTION

Although the device of the invention can be given a wide variety of shapes and configurations, its principle will now be explained with reference to two of the simplest embodiments of the invention.

a. A device according to the invention comprises a depilating head provided with a surface, generally a disk-shaped one, which is provided with an abrasive surface layer on all or part of its surface, and means for rotating such abrasive surface when the device is in use.

The abrasive surface may be an integral part of the rotating head or it may be in the form of an abrasive disk firmly attached to a rotating head.

b. A device as set out above, but with means for effecting the rotation in an excentric manner. For example, if an abrasive disk of say 20 mm diameter is used, this may be rotated with its axis set-off respective the axis of the driving means by about 1 to 2 mm. Such an excentric motion results in a vibration which facilitates the action of the device.

The abrasive disk can be provided with an abrasive surface on the entire surface. The abrasive disk can be provided with only a part of the area being provided with abrasive material, such as an annular ring of abrasive material which extends for about one fourth to about half the diameter of the disk. The disk may be provided with abrasive segments, and any other configuration may be resorted to.

The exact nature of the mode of operation of the device is not clear. It seems that the rapidly rotating abrasive surface engages the hairs from certain hair follicles, curls these, and after such curling detaches them from the support in the skin. In actual use, the device is moved back and forth over the area of the skin from which hair is to be removed, exerting a slight pressure on the skin.

The rotating member with the abrasive surface is advantageously provided with a circular housing which surrounds the abrasive disk. The abrasive disk is arranged in such a manner that the level of the disk respective the surrounding rim can be adjusted.

The invention is illustrated with reference to the enclosed schematical drawings, which are not according to scale, in which.

FIG. 8 (1) to 8(5) illustrates the appearance of a hair, its engagement by the abrasive 8(2) to 8(4) and its detachment 8(5);

FIG. 9 is a sectional view of the human skin with hair follicles, one of them in an enlarged view.

FIGS. 10 to 13 illustrate further configurations of abrasive rotating heads for use in a device of the invention.

The abrasive surface will generally be a disk-shaped one. There may be provided two or more adjacent abrasive surfaces, which enhances the depilatory effect. Effective radii are in the range of 15 to 25 mm diameter of the disk, but these are not limitative sizes. The abrasive disks are rotated at a rate of rotation of about 200 to 600 RPM, the preferred range being about 250 to 350 RPM.

A variety of abrasives may be used. There may be used disks of iron polishing cloth of the P-600 or P-800 grade which is commercially available, and which is used generally in a wet state. This is not so according to the present invention. A disk of such abrasive cloth may be attached to a suitable rotating support member, which can be flat, but which may also be slightly convex or even concave. It is preferred to provide an integral abrasive layer of suitable thickness, firmly bonded to a suitable support. It is advantageous to prepare discardable heads with such an abrasive surface, which are used for a certain period of time, and which are subsequently discarded and replaced by a new one. The device of the invention can be powered by a DC power source, such as a battery or battery arrangement: rechargeable batteries can be used.

It is advantageous to use conventional power outlets, and to use transforming means to reduce the voltage to say 12 volts. The outer rim may be made of metal, it can also be made of a resilient softer material, and also from silicon rubber. The outer rim can be provided with a teflon coating. This applies also to parts of the area of the abrasive disk which is not coated with abrasive.

Figure 10:
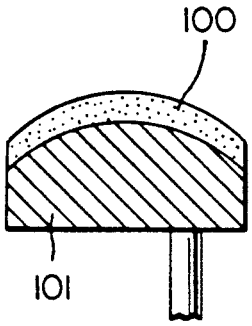
Figure 11:
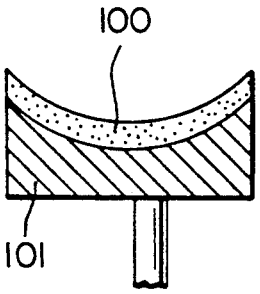
Figure 12:
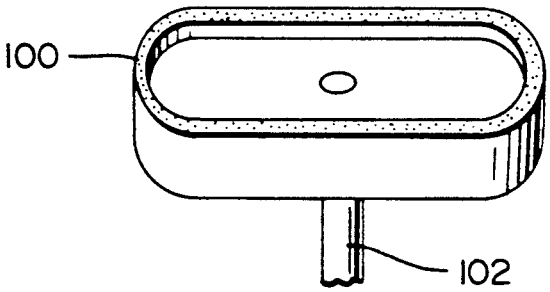
Figure 13:
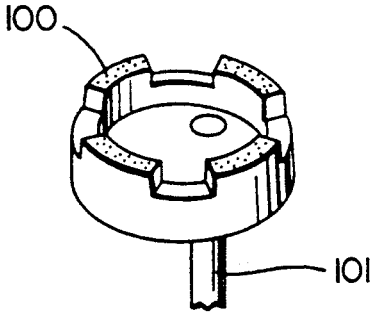

FIGS. 10 to 13 are perspective views of various embodiments of rotating heads with abrasive surfaces for use in the device of the invention. FIGS. 10 and 11 being elevational sections. In all of these, FIGS. 10 to 13, the upper surface 100 is provided with a layer of abrasive substances of fine grain size. FIGS. 10, 11 and 13 illustrate heads with an excentric drive shaft 101, whereas FIG. 12 illustrates such a head with an excentric drive shaft 102, The overall size of the heads will be in the range of 15–20 mm diameter. In FIG. 12 this defines the larger diameter of the head.

The device may comprise more than one abrasive head, and such heads will be in the same plane and close to one another.

FIGS. 10 and 11, not according to scale, illustrate in an exaggerated manner that the upper surface is not necessarily a plane one. FIG. 10 illustrates a curved upper surface, and FIG. 11 a concave one. In actual practice the curvature will generally be a less pronounced one. FIG. 102 illustrates a head with an annular abrasive surface; it ought to be understood that the abrasive surface can also extend over the entire upper surface of the head. Various other and different configurations of the shape and surface of the rotating head can be resorted to.

Figure 1:
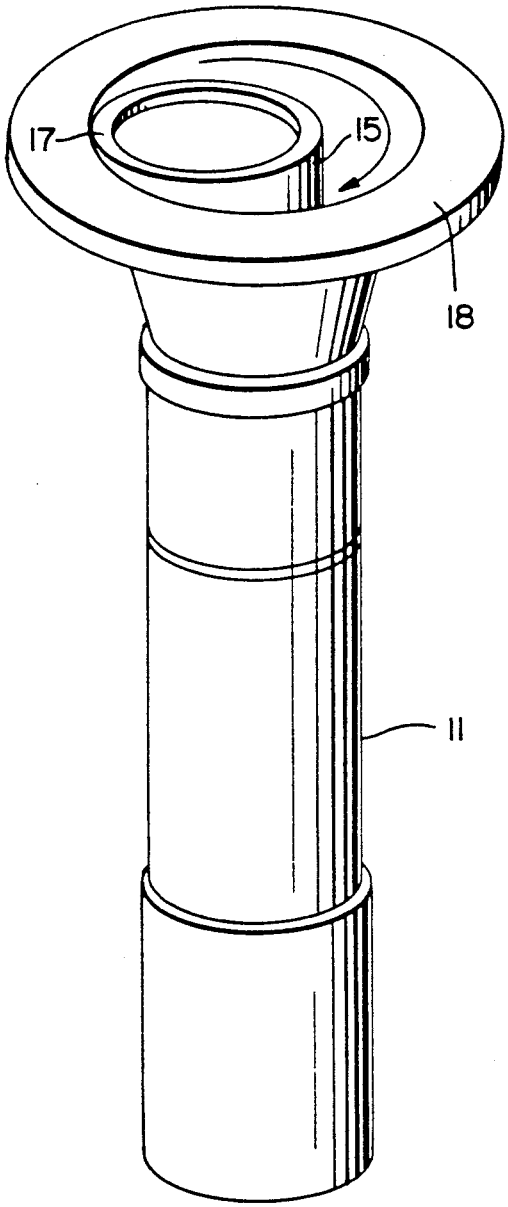
FIG. 1 is a perspective side-view of a device of the invention.
Figure 2:
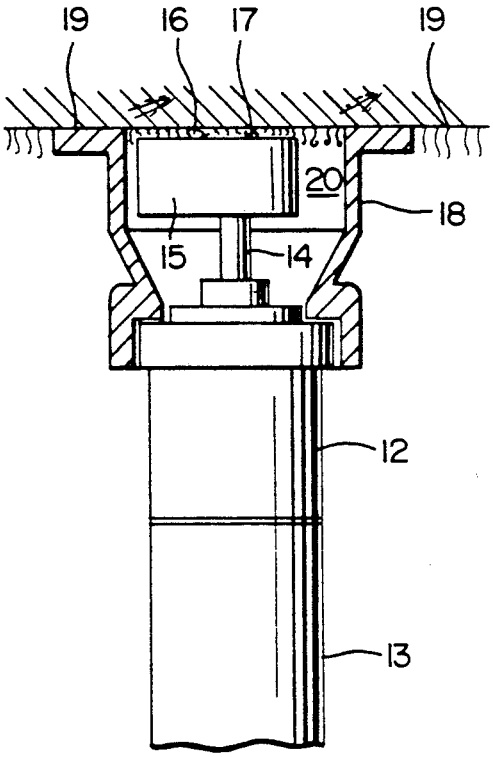
FIG. 2 is a side-view of the same device in partial section.
Figure 3:
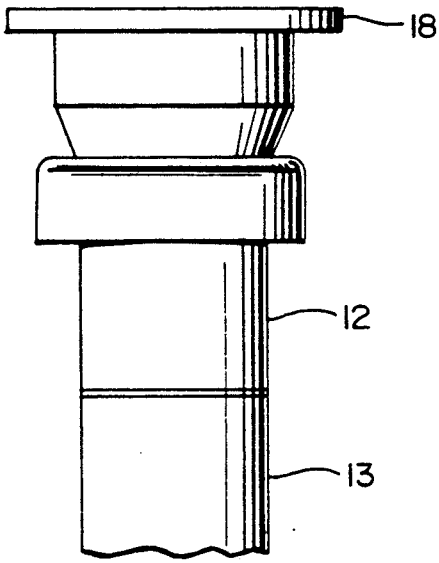
FIG. 3 is an elevational side-view of the upper part of a device of the invention.
Figure 4:
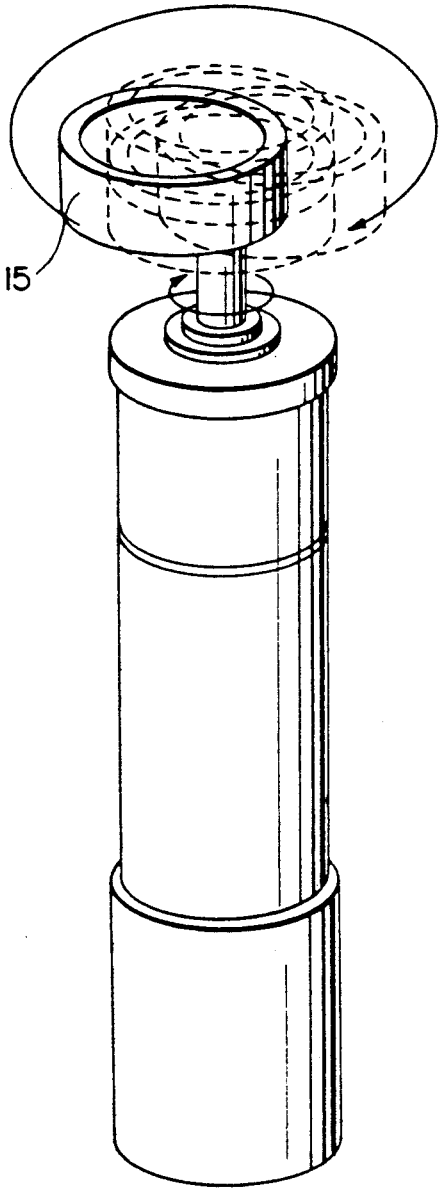
FIG. 4 is an elevational perspective side-view of a device of the invention, illustrating the movement of the rotating excentric head of the device.
Figure 5:
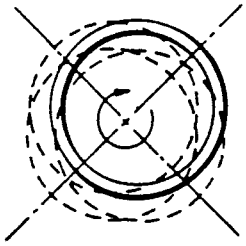
FIG. 5 is a top view of rotating head of the invention.
Figure 6:
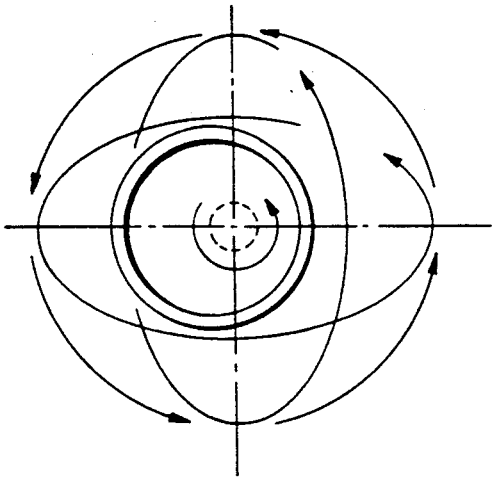
FIG. 6 is a schematic top view of rotating head of the invention.

As illustrated in FIGS. 1, 2 and 3, a device according to the invention comprises a housing 11, inside which there is located a small electro-motor 12 powered by a power source like one or more batteries 13, which motor actuates and rotates via shaft 14 the rotating head 15. The shaft 14 is arranged in an excentric manner respective the center of 15, which is provided at its surface 16 with a layer of abrasive substance 17. The housing is provided with a cup-shaped member 18 which extends at its upper part to the form of an annular flat member which has its upper surface a small distance above the surface of the rotating head 15. In FIG. 2 there is indicated the surface of the skin 19 from which there extend hairs 20. When the head 15 is rotated at a suitable rate of rotation, as set out above, the abrasive surface thereof contacts the hairs and these are removed from the skin with a minimum of discomfort. FIGS. 4, 5 and 6 illustrate the excentric movement of the rotating head 15 in an excentric manner.

Figure 7:
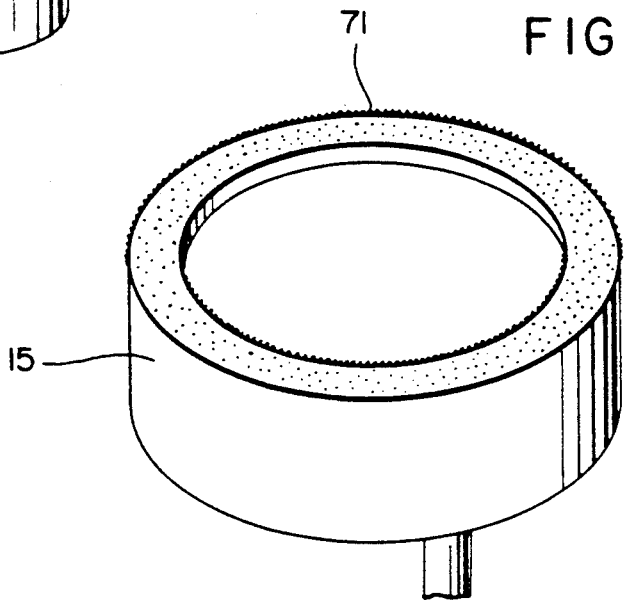
FIG. 7 is a perspective view of the head of the device of the invention, in an embodiment which comprises an annular abrasive area.

The surface of the rotating head can be a continuous plane one; it can also be one with an annular configuration, as shown in FIG. 7, where 71 is the abrasive upper surface. It is again stressed that the upper surface of the rotating head can have any desired shape, with all or part of it being provided with a surface of an abrasive material.

The rotating head is generally provided with a fine mesh abrasive so as not to cause any injury or irritation to sensitive human skin. The invention also relates to a method of depilating hair from the human body, especially arms and legs, which method comprises contacting the area from which skin is to be removed with a rotating head provided with an abrasive surface. Such abrasive head is advantageously a head of a device as set out in the foregoing description and as illustrated by way of example in the Figures.

I claim:

1. A depilatory device for the removal of hair from various parts of the human body, said depilatory device comprising a housing having an annular rim with a flat surface, a rotatable head mounted in said housing and having an uppermost surface, at least part of said uppermost surface including an abrasive layer forming a part thereof, and means for eccentrically rotating such head in said housing at a predetermined rate of rotation with said uppermost surface eccentrically rotating in a plane extending substantially parallel to said flat surface of said annular rim.

2. A device according to claim 1, wherein the rotatable head is disk shaped and where the abrasive layer covers certain segments thereof.

3. A device according to claim 1, wherein the rotatable head is flat.

4. A device according to claim 1, wherein the rotatable head is surrounded by said annular rim, and means being provided for adjusting the level of the rotating head respective said annular rim.

5. A device according to claim 1 wherein the rotatable head is rotated at a speed of from 200 to 600 RPM.

6. A device according to claim 1, wherein the abrasive layer is an abrasive of very fine grain size.

7. A device according to claim 1, wherein the rotating head is actuated by an electric motor driven by batteries.

8. A depilatory device according to claim 1, wherein said rotatable head is of non-circular configuration.

9. A depilatory device according to claim 1, wherein the rotatable head is sightly concave.

10. A depilatory device according to claim 1, wherein the rotatable head is slightly convex.

* * * * *